United States Patent [19]

Kageyama et al.

[11] Patent Number: 4,975,338

[45] Date of Patent: Dec. 4, 1990

[54] THIN FILM ELECTROLUMINESCENCE DEVICE

[75] Inventors: Yoshiyuki Kageyama; Seiichi Ohseto; Kenji Kameyama; Hiroshi Deguchi, all of Yokohama, Japan

[73] Assignee: Ricoh Company, Ltd., Tokyo, Japan

[21] Appl. No.: 337,160

[22] Filed: Apr. 12, 1989

[30] Foreign Application Priority Data

Apr. 12, 1988 [JP] Japan ..... 63-88047
Apr. 13, 1988 [JP] Japan ..... 63-89309

[51] Int. Cl.[5] ..... H05B 33/14; H05B 33/22

[52] U.S. Cl. ..... 428/690; 313/503; 313/509

[58] Field of Search ..... 428/690, 691; 313/503, 313/509

[56] References Cited

U.S. PATENT DOCUMENTS 4,594,282 6/1986 Kawaguchi et al. ..... 313/509
4,717,858 1/1988 Tanaka et al. ..... 313/509
4,737,684 4/1988 Seto et al. ..... 313/509
4,774,435 9/1988 Levinson ..... 313/509

*Primary Examiner*—James Seidleck
*Attorney, Agent, or Firm*—Oblon, Spivak, McClelland, Maier & Neustadt

[57] ABSTRACT

A thin film EL device is disclosed which comprises (a) a substrate, (b) a transparent electrode layer formed on the substrate, (c) one or more insulating layers formed on the transparent electrode layer, with at least one of the insulating layers comprising a crystalline nitride, (d) an electroluminescent emitting layer comprising a luminescent host material consisting of an alkali earth calcogen compound formed on the insulating layers, and (e) a back electrode layer. In the above thin film EL device, it is preferable that the insulating layer in contact with the electroluminescent layer comprise a crystalline aluminum nitride or boron nitride, and that the transparent electrode layer comprise a host material consisting of a C-axis oriented zinc oxide.

21 Claims, 3 Drawing Sheets

THIN FILM ELECTROLUMINESCENCE DEVICE

BACKGROUND OF THE INVENTION

1. Field of the Invention

This invention relates to a thin film electroluminescence (hereinafter referred to as EL) device which can be used as an EL display.

2. Discussion of Background

An EL device is currently utilized as a flat pannel display which has a large capacity and is capable of representing visible images of high quality.

The EL device is typically fabricated in such a manner that a transparent electrode layer, a first insulating layer, an EL emitting layer, a second insulating layer and a back electrode layer are succesively formed on a substrate of transparent glass in the mentioned order. The EL device entirely consists of solid materials, so that it has high mechanical strength and enviromental resistance, and therefore the EL device is suitable for use as the display of portable word processors and computers.

Typical examples of host materials for a multi-color EL device are alkali earth metal sulfides such as SrS and CaS, and alkali earth metal selenides such as SrSe and CaSe. However, an EL device which comprises an EL emitting layer containing such a host material cannot maintain high reliability for a prolonged period.

In order to overcome the above drawback of the conventional EL devices, it has been proposed to employ a nitride layer as an insulating layer as disclosed in Japanese Laid-Open Patent Application No. 62-5596 and Japanese Patent Application No. 60-228863. However, detailed studies on the nitride insulating layer, especially, with respect to the crystallinity of the nitride and the thickness of the layer, have never been made so far, and it has only been known that amorphous layers are preferable as the insulating layer. An EL device which comprises an amorphous nitride layer as an insulating layer emits weak EL and has unsatisfactory breakdown strength.

Japanese Laid-open Patent Application No. 61-198592 discloses an EL device comprising a transparent electrode layer made of a C-axis oriented zinc oxide. However, when an alkali earth chalcogen compound is used as a host material, the EL device cannot maintain high reliability for a prolonged period.

Further, an insulating layer containing a crystalline nitride has been employed in an EL device which comprises an alkali earth chalcogen compound as a host material. However, satisfactory luminance and breakdown strength cannot be attained even by such an EL device.

In addition, a transparent electrode layer comprising a crystalline material has not been reported as yet.

SUMMARY OF THE INVENTION

It is therefore an object of the present invention to provide a multi-color EL device capable of emitting high-luminance EL and maintaining high reliability for a prolonged period of time.

The foregoing object of the present invention can be attained by a thin film EL device which comprises (a) a substrate, (b) a transparent electrode layer formed on the substrate, (c) one or more insulating layers formed on the transparent electrode layer, with at least one of the insulating layers comprising a crystalline nitride, (d) an electroluminescent emitting layer comprising a luminescent host material consisting of an alkali earth chalcogen compound formed on the insulating layers, and (e) a back electrode layer. In the above thin film EL device, it is preferable that the insulating layer in contact with the electroluminescent layer comprise a crystalline aluminum nitride or boron nitride, and that the transparent electrode layer comprise a host material consisting of a C-axis oriented zinc oxide.

DESCRIPTION OF THE PREFERRED EMBODIMENTS

By referring to the accompanying drawings, the present invention will now be explained in more detail.

Figure 1:
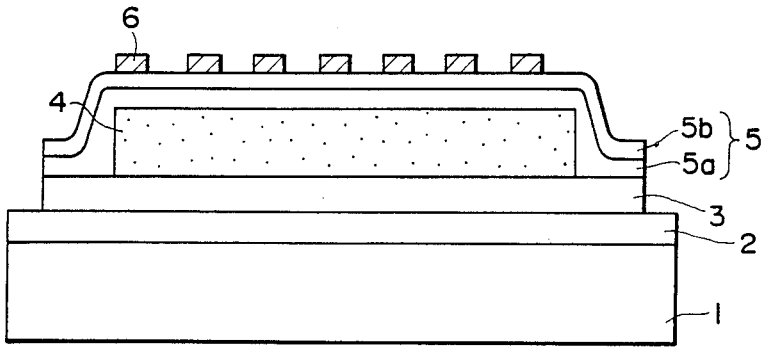
FIG. 1 is a schematic illustration of the structure of a thin film EL device No. 1 according to the present invention.

FIG. 1 is a schematic cross-sectional view of an example of a thin film EL device of the present invention which comprises a glass substrate 1 on which a transparent electrode layer 2, a first insulating layer 3, an EL emitting layer 4, a second insulating layer 5, and a back electrode layer 6 are succesively formed in this order.

Soda-lime glass, borosilicate glass, aluminosilicate glass and quartz glass are usable as the material for the glass substrate 1. Of these, borosilicate and aluminosilicate are preferable for use when the heat-resistance, the cost of the final EL display product and the concentration of alkali contained therein are taken into consideration.

The transparent electrode layer 2 can be made of ITO and Sb-doped $SnO_2$, or Al- or Si-doped ZnO. In the case of employing the ZnO layer, a C-axis oriented ZnO is preferable used. In particular, an EL device which comprises a transparent electrode layer of the C-axis oriented ZnO whose half value ($\Delta 2\theta$) of the X-ray diffraction peak is 0.4° or less emits EL with high luminace and has an improved breakdown strength. A preferable thickness of the transparent electrode layer ranges from 1,000 Å to 5,000 Å.

The first insulating layers 3 and the second insulating layer 5 both may consist of two or more constituent layers. It is preferable that at least one constituent layer which is in contact with the EL emitting layer be made of crystalline aluminum nitride (hereinafter referred to as AlN) or crystalline boron nitride (hereinafter referred to as BN). Conventionally it has been considered that an amorphous material is preferable for use in an insulating layer of an EL device, but in the present invention, polycrystalline or single crystalline AlN and BN are preferably employed for use in the insulating layer. This is because polycrystalline AlN and BN have so high a breakdown strength that they can improve the breakdown strength of the EL device when they are used in the unsulating layer.

It is preferable that the AlN and BN layers have a thickness ranging from 1,000 Å to 2 μm when the breakdown strength, threshold voltage and exfoliation of the layer are taken into consideration.

It is preferable that at least the first insulating layer 3 and the second insulating layer 5 comprise the above-mentioned AlN or BN layer which is disposed in direct contact with the EL emitting layer 4. In addition, the two insulating layers 3 and 5 may comprise an oxide insulating layer comprising an oxide which is disposed out of contact with the EL emitting layer 4 in such a configuration that the ALN or BN layer is interposed between the EL emitting layer 4 and the oxide insulating layer. As the oxides for the oxide insulating layer, dielectric materials such as $SiO_2$, $Al_2O_3$, $Ta_2O_5$, $SrTiO_3$ and $PbTiO_3$ can be employed. A preferable thickness of the oxide insulating layer is in the range of 500 Å to 3,000 Å, preferably 1,000 Å to 2,000 Å, and more preferably 1,200 Å to 1,800 Å.

The EL emitting layer 4 comprises a host material and an activator. The host material is an alkali earth chalcogen compound, for instance, an alkali earth metal sulfide such as SrS, CaS and BaS, and an alkali earth metal selenide such as SrSe, CaSe and BaSe. Of these, SrS and CaS are preferable for use in the present invention. The activator is a rare earth element such as Ce, Pr, Sm, Eu, Tb and Tm. Of these, Ce and Eu are preferable for use in the present invention. By an appropriate combination of any of the above host materials and activators, a variety of EL colors, such as red, green and blue, can be obtained as desired. A suitable thickness of the EL emitting layer 4 ranges from 5,000 Å to 15,000 Å, preferably from 8,000 Å to 12,000 Å.

The back electrode layer 6 can be made of a metal such as aluminum or any of the same materials as employed for preparation of the transparent electrode layer 2. A suitable thickness of the back electrode layer 6 ranges from 1,000 Å to 10,000 Å, preferably 2,000 Å to 3,000 Å.

Each of the above-described thin layers is formed by the conventional thin-layer-formation method, such as vacuum deposition, ion plating, sputtering and chemical vapor deposition.

This invention will now be explained more specifically by referring to the following examples, which are given for illustration of the invention and are not limiting thereof.

EXAMPLE 1

A thin film EL device No. 1 according to the present invention, as illustrated in FIG. 1, was fabricated by successively overlaying on a substrate 1 made of aluminosilicate glass having a thickness of 1.1 mm, a ZnO:Al transparent electrode layer 2 having a thickness of 2,000 Å, an AlN layer 3 having a thickness of 2,000 Å serving as a first insulating layer, a SrS:Ce EL emitting layer 4 having a thickness of 1 μm, an AlN layer 5a having a thickness of 2,000 Å which is in contact with the SrS:Ce EL emitting layer 4, a $SiO_2$ layer 5b having a thickness of 1,000 Å formed on the AlN layer 5a, which layers 5a and 5b serve as a second insulating layer 5, and an Al back electrode layer (1,000 Å) in the mentioned order.

The film EL devices having the above structure were fabricated in which the crystallinity of the ZnO:Al transparent electrode layer was fixed at 0.4° in $\Delta 2\theta$ and the crystallinity of the AlN layers 3 and 5a was changed variously, so that the characteristic correlation curve between the voltage applied to the EL devices and the luminance emitted therefrom was obtained. In the measurement for obtaining the above correlation, each thin film EL device was drived by an alternative pulse with a frequency of 1 kHz and a pulse width of 100 μs, at room temperature.

From the characteristic correlation curve breakdown voltage ($V_{BD}$) and the threshold voltage ($V_{th}$) of each EL device were determined. The threshold voltage (Vth) here means a voltage by which a luminance (L) of 1 cd/m$^2$ can be obtained from each EL device. The difference between $V_{BD}$ and $V_{th}$ was taken as an index of the breakdown strength of the EL device.

The crystallinity of the AlN layer 5a was determined by an X-ray diffraction method by using a "Geiger Flex 4036A1" (trademark) made by Rigaku Denki K.K. The crystallinity was represented by a reciprocal number ($1/\Delta 2\theta$) of the half width ($\Delta 2\theta$) of the diffraction pattern.

Figure 2:
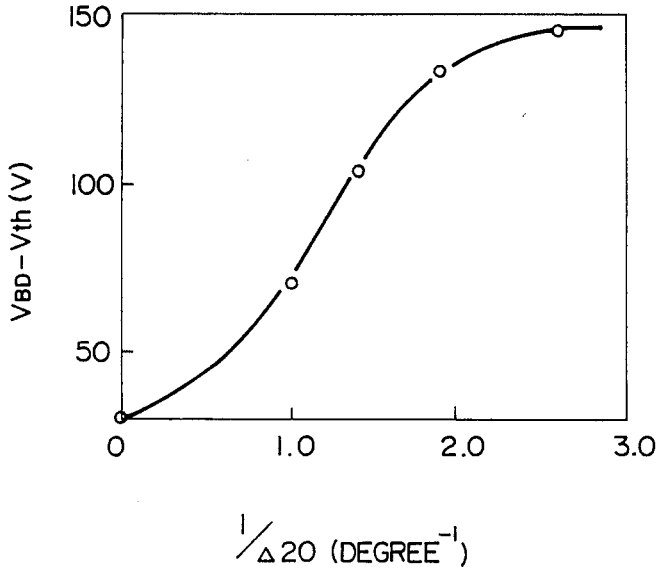
FIG. 2 is a graph showing the relationship between the crystallinity of a crystalline AlN insulating layer of the EL device No. 1 shown in FIG. 1 and the breakdown strength thereof.

FIG. 2 is a graph showing the relationship between the crystallinity of the ALN layer and the breakdown strength of the EL device. In the case where no peaks appeared in the X-ray diffraction pattern, in other words, in the case of an amorphous AlN layer, the crystallinity ($1/\Delta 2\theta$) was indicated as being zero. When an amorphous Al insulating layer is employed, its breakdown strength is extremely low. As can be seen from the graph in FIG. 2, the higher the crystallinity of the AlN layer 5a, the higher the breakdown strength of the EL device; and a remarkable increase in the breakdown strength can be observed when the crystallinity ($1/\Delta 2\theta$) exceeds 1. It is preferable that the crystallinity of the insulating layer be 1 or more, preferably 2.0 or more.

Thus, the EL devices comprising a crystalline AlN layer as the insulating layer has high reliability.

EXAMPLE 2

Thin film EL devices were fabricated in the same manner as in Example 1 except that the thickness of the AlN layer 5a of each EL device was varied, so that the breakdown strength of each EL device was measured.

Figure 3:
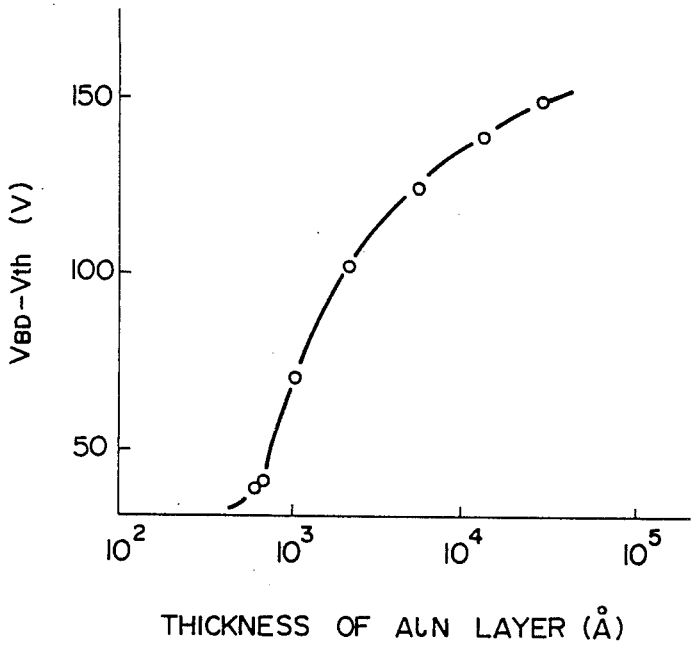
FIG. 3 is a graph showing the relationship between the thickness of a crystalline AlN insulating layer of the EL device No. 1 according to the present invention and the breakdown strength thereof.

FIG. 3 is a graph showing the relationship between the thickness of the AlN layer 5a and the breakdown strength of each EL device. This graph indicates that the breakdown strength of each EL device highly depends on the thickness of the AlN layer 5a. When the thickness exceeds 1,000 Å, the breakdown strength drastically increases.

Figure 4:
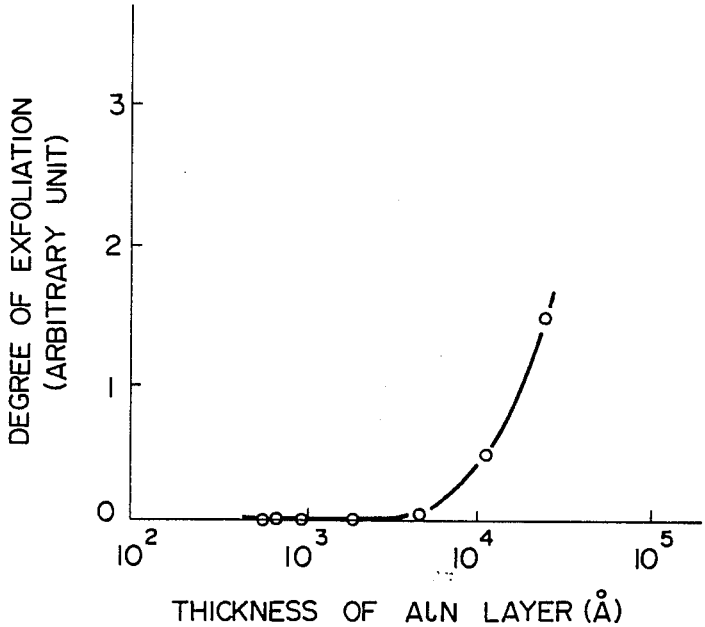
FIG. 4 is a graph showing the relationship between the thickness of the AlN layer and the degree of exfoliation of the AlN layer of the EL device No. 1 according to the present invention.

In order to observe exfoliation of the laminated layers of the EL devices, the above fabricated EL devices were energized and driven intermittently at an elevated temperature of 80° C. FIG. 4 is a graph showing the relationship between the thickness of the AlN layer 5a and the degree of exfoliation thereof. The degree of exfoliation was evaluated by microscopic observation. In the graph, zero means that no exfoliation of the AlN layer took place. Considerable exfoliation took place when the thickness of the AlN layer exceeds 2 μm.

Thus, a suitable thickness of the AlN layer 5a is in the range of 1,000 Å to 2 μm. By using an AlN layer having a thickness in this range, an EL device having high reliability can be obtained.

EXAMPLE 3

Figure 5:
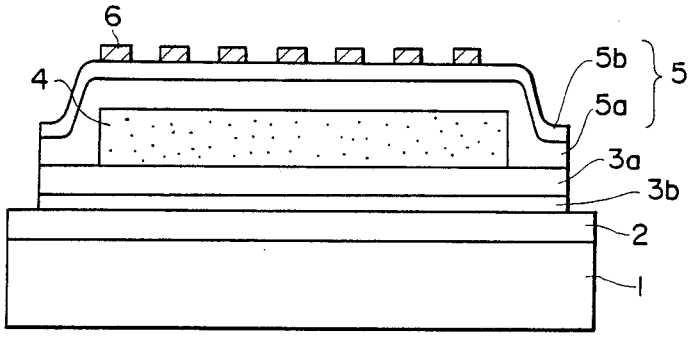
FIG. 5 is a schematic illustration of the structure of a thin film EL device No. 2 according to the present invention.

A thin film EL device No. 2 according to the present invention, as illustrated in FIG. 5, was fabricated in the same manner as in Example 1 except that the AlN layer 3 serving as the first insulating layer of the EL device in Example 1 was replaced with an AlN insulating layer 3a and a $SiO_2$ insulating layer 3b which are disposed in such a configuration that the AlN insulating layer 3a is disposed in contact with the EL emitting 4.

EXAMPLE 4

Figure 6:
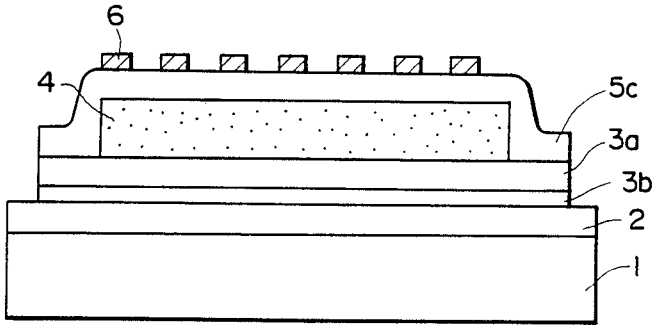
FIG. 6 is a schematic illustration of the structure of a thin film EL device No. 3 according to the present invention.

A thin film EL device No. 3 according to the present invention was fabricated, as illustrated in FIG. 6, was fabricated in the same manner as in Example 3 except that the AlN layer 5a and the $SiO_2$ layer 5b were replaced by an AlN layer 5c consisting of AlN.

With respect to the above-prepared three thin film EL devices No. 1, No. 2 and No. 3 according to the present invention, the characteristic correlation curve between the voltage applied to each EL device and the illuminance of the EL emitted therefrom was obtained. As a result, the EL device No. 1 fabricated in Example 1 showed the lowest threshold voltage and the highest illuminance compared with the other two EL devices.

By using BN, instead of AlN, for the insulating layers, the same experiments as the above were carried out. As a result, it was found that BN has the same advantageous effects and actions as AlN has.

Thus, the reliability of an EL device which comprise an alkali earth chalcogen compound as a host material in an EL emission layer can be improved by employing a crystalline nitride layer as at least one of insulating layers thereof.

EXAMPLE 5

EL devices were fabricted in the same structure as described in Example 1 except that the crystallinity of each AlN layer was fixed at 0.5° in $\Delta 2\theta$ and the crystallinity of the ZnO:Al transparent electrode layer 2 was variously changed.

The crystallinity of the ZnO:Al transparent electrode layer 2 was determined in accordance with an X-ray diffraction method using a "Geiger Flex 4036A1" made by Rigaku Denki K.K. The crystallinity was represented by a reciprocal number ($1/\Delta 2\theta$) of the half width ($\Delta 2\theta$) of the diffraction pattern The characteristic X-ray used in the above was CuKa.

Figure 7:
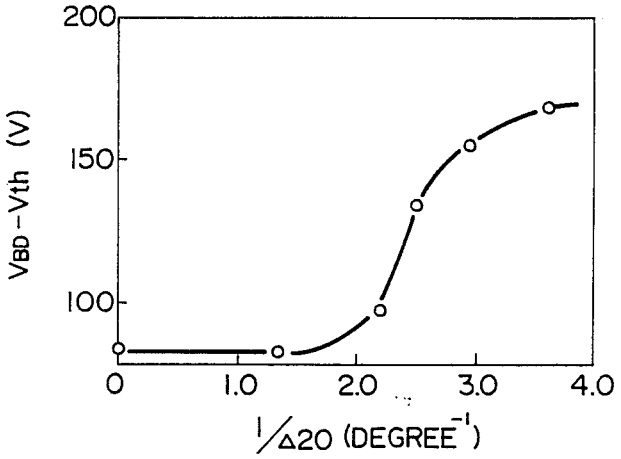
FIG. 7 is a graph showing the relationship between the crystallinity of a ZnO:Al transparent electrode layer and the breakdown strength of the EL device No. 1 shown in FIG. 1.

The graph shown in FIG. 7 shows the relationship between the crystallinity of the ZnO:Al and the breakdown strength of the EL device. In the case where no peak was appeared in the diffraction pattern by the X-ray, in other words, in the case of an amorphous layer, the crystallinity ($1/\Delta 2\theta$) was indicated by zero. By the X-ray diffraction method, it was determined that the ZnO:Al transparent electrode comprises a C-axis (0002) oriented zinc oxide as the host material. The results shown in FIG. 7 indicates that a C-axis oriented zinc oxide improves the breakdown strength of the EL device, and that when the crystallinity ($1/\Delta 2\theta$) exceeds 2.5, the breakdown strength of the EL device drastically increases.

By using ITO, instead of the ZnO:Al, in the transparent electrode layer, the above experiment was carried out. As a result, it was found that the EL device comprising the ITO electrode layer had a lower breakdown strength as compared with the one comprising the ZnO:Al electrode layer.

Thus, the reliability of an EL device which comprises an alkali earth chalcogen compound as a host material in an EL emission layer can be improved by employing both a first insulating layer made of AlN, and a transparent electrode layer comprising a C-axis oriented ZnO as a host material.

What is claimed is:

1. A thin film electroluminescence device comprising:

a substrate, a transparent electrode layer formed on said substrate, an insulating layer consisting of one or more constituent layers formed on said transparent electrode layer, at least one of said constituent insulating layers comprising a crystalline aluminum nitride or boron nitride wherein the crystallinity of said crystalline nitride is 1 or more when indicated by a reciprocal number of the half width of the X-ray diffraction pattern, an electroluminescence emitting layer comprising an electroluminescence host material and an activator, formed on said constituent insulating layer comprising a crystalline nitride, said electroluminescence host material being an alkali earth chalcogen compound, and said activator being a rare earth element, and a transparent back electrode layer formed on said electroluminescence layer.

2. The thin film electroluminescence device as claimed in claim 1, further comprising a second insulating layer comprising one or more constituent layers between said electroluminescence emitting layer and said transparent back electrode layer, at least one of said constituent insulating layers comprising a crystalline nitride and being in contact with said electroluminescence emitting layer.

3. The thin film electroluminescence device as claimed in claim 2, wherein the thickness of said second insulating layer is in the range of from 1,000 Å to 2 μm.

4. The thin film electroluminescence device as claimed in claim 2, wherein said constituent insulating layer other than said constituent layer comprising a crystalline nitride comprises a dielectric compound selected from the group consisting of $SiO_2$, $Al_2O_3$, $Ta_2O_5$, $SrTiO_3$ and $PbTiO_3$.

5. The thin film electroluminescence device as claimed in claim 4, wherein the thickness of said constituent layer comprising said dielectric compound is in the range of from 500 Å to 3,000 Å.

6. The thin film electroluminescence device as claimed in claim 1, wherein said transparent back electrode layer comprises a C-axis oriented zinc oxide as a host material.

7. The thin film electroluminescence device as claimed in claim 1, wherein said crystalline nitride is a crystalline aluminum nitride.

8. The thin film electroluminescence device as claimed in claim 1, wherein said crystalline nitride is a crystalline boron nitride.

9. The thin film electroluminescence device as claimed in claim 1, wherein said alkali earth chalcogen compound is an alkali earth metal sulfide selected from the group consisting of SrS, CaS and BaS.

10. The thin film electroluminescence device as claimed in claim 1, wherein said alkali earth chalcogen compound is an alkali earth metal selenide selected from the group consisting of SrSe, CaSe and BaSe.

11. The thin film electroluminescence device as claimed in claim 1, wherein said rare earth element is selected from the group consisting of Ce, Pr, Sm, Eu, Tb and Tm.

12. The thin film electroluminescence device as claimed in claim 1, wherein said substrate is made of a material selected from the group consisting of soda-lime glass, borosilicate glass, aluminosilicate glass and quartz glass.

13. The thin film electroluminescence device as claimed in claim 1, wherein said transparent electrode layer is made of a material selected from the group consisting of Al, ITO, Sb-doped $SnO_2$, Al-doped ZnO, and Si-doped ZnO.

14. The thin film electroluminescence device as claimed in claim 11, wherein said Al-doped ZnO and said Si-doped ZnO are of a C-axis oriented crystalline type.

15. The thin film electroluminescence device as claimed in claim 1, wherein the thickness of said transparent electrode layer is in the range of from 1,000 Å to 5,000 Å.

16. The thin film electroluminescence device as claimed in claim 1, wherein the thickness of said insulating layer is in the range of from 1,000 Å to 2 μm.

17. The thin film electroluminescence device as claimed in claim 1, wherein said constituent insulating layer other than said constituent layer comprising a crystalline nitride comprises a dielectric compound selected from the group consisting of $SiO_2$, $Al_2O_3$, $Ta_2O_5$, $SrTiO_3$ and $PbTiO_3$.

18. The thin film electroluminescence device as claimed in claim 17, wherein the thickness of said constituent layer comprising said dielectric compound is in the range of from 500 Å to 3,000 Å.

19. The thin film electroluminescence device as claimed in claim 1, wherein the thickness of said electroluminescence emitting layer is in the range of from 5,000 Å to 15,000 Å.

20. The thin film electroluminescence device as claimed in claim 1, wherein said back electrode layer is made of a material selected from the group consisting of Al, ITO, Sb-doped $SnO_2$, Al-doped ZnO and Si-deoped ZnO.

21. The thin film electroluminescence device as claimed in claim 1, wherein the thickness of said back electrode layer is in the range of from 1,000 Å to 10,000 Å.

* * * * *

UNITED STATES PATENT AND TRADEMARK OFFICE

CERTIFICATE OF CORRECTION

PATENT NO. : 4,975,338

DATED : December 4, 1990

INVENTOR(S) : Kageyama et al.

It is certified that error appears in the above-identified patent and that said Letters Patent is hereby corrected as shown below:

Column 1, line 10, "pannel" should read --panel--

Column 2, line 48, "succesively" should read --successively-- line 59, "preferable" should read --preferably--

Line 62, "luminace" should read --luminance--

Line 67, "layer" should read --layers--

Column 3, line 11, "unsulating" should read --insulating--

Column 4, line 15, "drived" should read --driven-- line 22, "(Vth)" should read --($V_{th}$)-- line 33, "ALN" should read --AlN--

Column 5, line 36, "comprise" should read --comprises--

Column 5, line 39, "of insulating" should read --of the insulating--

Column 5, line 43, "fabricted" should read --fabricated--

Column 5, line 53, after "diffraction pattern" insert a period --.--

UNITED STATES PATENT AND TRADEMARK OFFICE

CERTIFICATE OF CORRECTION

PATENT NO. : 4,975,338

DATED : December 4,1990

INVENTOR(S) : Kageyama et al.

It is certified that error appears in the above-identified patent and that said Letters Patent is hereby corrected as shown below:

Column 5, line 58, "peak was appeared" should read

--peak appeared--

Column 5, line 64, "indicates" should read --indicate--

Column 7, line 25, "claim 11" should read --claim 13--

Column 8, line 23, "Si-deoped" should read --Si-doped--

Signed and Sealed this

Twenty-eighth Day of July, 1992

*Attest:*

DOUGLAS B. COMER

*Attesting Officer*

*Acting Commissioner of Patents and Trademarks*